US006308904B1

(12) United States Patent
Chang

(10) Patent No.: US 6,308,904 B1
(45) Date of Patent: Oct. 30, 2001

(54) DELAY DRIVE-HANGING DEVICE OF A PAPER SHREDDER

(76) Inventor: Frank Chang, 3rd Fl., 200, Sin-Yi Rd., Sec. 3, Taipei (TW)

( * ) Notice: Subject to any disclaimer, the term of this patent is extended or adjusted under 35 U.S.C. 154(b) by 0 days.

(21) Appl. No.: 09/571,599

(22) Filed: May 15, 2000

(51) Int. Cl.[7] ..... B02C 11/08

(52) U.S. Cl. ..... 241/36; 241/236

(58) Field of Search ..... 241/34, 36, 236

(56) References Cited

U.S. PATENT DOCUMENTS

| | | | | |
|---|---|---|---|---|
| 5,167,374 | * | 12/1992 | Strohmeyer | 241/36 |
| 5,772,605 | * | 7/1998 | Tsai | 241/36 |
| 5,984,215 | * | 11/1999 | Huang | 241/36 |
| 6,213,417 | * | 4/2001 | Schwelling | 241/36 |

* cited by examiner

*Primary Examiner*—Ed Tolan
(74) *Attorney, Agent, or Firm*—Dougherty & Troxell

(57) ABSTRACT

This invention is related to a delay drive-hanging device of a paper shredder. The paper shredder is provided with a linked delay device that maintains continuous driving force within the duration from insertion of paper between blade wheel shafts to termination of shredding operation so as to effectively grip and then strip the paper. The device is provided on the blade wheel shafts; the device drives and connects to a link dial by means of a belt. The link dial has an end that couples to a control cylinder by means of minute friction. A delay trigger for a paper entry dial is provided between a side of a paper entrance and the control cylinder. A micro-switch is connected to a primary circuit. The control cylinder has an end face having a notch that corresponds to and controls a retaining dial of the delay trigger. The control cylinder is provided on another side with a resilient press plate that corresponds to and controls a recovering dial. Further, the delay trigger is provided with a cantilever beam at a location adjacent the micro-switch such that insertion of paper changes orientation of the delay trigger to cause the cantilever beam to contact and to activate the micro-switch; after an end edge of the paper is gripped, the delay trigger is triggered by the retaining dial to recover to its original state, while the end face of the control cylinder urges against the micro-switch such that the micro-switch continues to be activated for a while until the control cylinder completes a full rotation subjecting the cantilever beam to sink in the notch so as to cease the driving force.

1 Claim, 5 Drawing Sheets

DELAY DRIVE-HANGING DEVICE OF A PAPER SHREDDER

SUMMARY OF INVENTION

This invention is related to a delay drive-hanging device of a paper shredder. The paper shredder is provided with a linked delay device that maintains continuous driving force within the duration from insertion of paper between blade wheel shafts to termination of shredding operation so as to effectively grip and then strip the paper. The device is provided on the blade wheel shafts; the device drives and connects to a link bar by means of a belt. The link bar has an end that couples to a control cylinder by means of minute friction. A delay trigger for a paper entry dial is provided between a side of the paper entrance and the control cylinder. A micro-switch is connected to a primary circuit. The control cylinder has an end face having a notch that corresponds to and controls a retaining dial of the delay trigger. The control cylinder is provided on another side with a resilient press plate that corresponds to and controls a recovering dial. Further, the delay trigger is provided with a cantilever beam at a location adjacent the micro-switch such that insertion of paper changes orientation of the delay trigger to cause the cantilever beam to contact with and to activate the micro-switch; after an end edge of the paper is gripped, the delay trigger is triggered by the retaining dial to recover to its original state, while the end face of the control cylinder urges against the micro-switch such that the micro-switch continues to be activated for a while until the control cylinder completes a full rotation subjecting the cantilever beam to sink in the notch so as to cease the driving force.

Paper shredders are used to prevent leakage of printed information such that confidential information can be diminished along with the paper after passing through the paper shredders. Conventional paper shredders each include a motor that drives rolling blades through a gearbox such that the blade edges (each in a tined or serrated form) grip the paper and then shred the paper into strips or fragments. However, conventional paper shredders are driven in such a manner that, when paper is inserted into the paper entrance of the paper shredders, gravitational force of the inserted paper lightly strokes a micro-switch so as to activate the power empowering the motor to drive the blade wheel to grip and then strip the paper. However, once the end edge of the paper has been gripped, the stroking force as a result of the gravitational force gradually reduces and eventually diminishes. Since the micro-switch is away from the shredding blade wheel at a distance, the motor ceases rotation before the paper has been fully shredded to leave a non-shredded segment next to the paper entrance, which segment is not gripped and shredded until the next shredding operation that activates the motor. Such a non-shredded segment may leak the confidential information, and the paper fragments left between the blade wheels may also obstruct the paper entry of the next shredding operation.

Therefore, using the paper to activate the micro-switch is insufficient to fully shred the paper, because the micro-switch is provided at the upstream and the shredding blade wheel is at the downstream that is away from the upstream at a distance, which is the cause of leaving a non-shredded segment. Since difficulties involved in changing the mechanisms, one solution is to prolong the driving duration of the blade wheel so as to fully shred the paper.

One known solution for delaying the above motor operation relies on electronic components provided on a printed circuit board (PCB). However, disadvantages, such as high cost of the electronic components, and damages of the electronic components that cause malfunctioning of the entire PCB, are maintenance problems that manufacturer and consumers have encountered with such a solution.

In view of the above, the "delay drive-hanging device of a paper shredder" of this invention is invented in an attempt to solve the above problems after diligent trials and researches.

It is thus a primary object of this invention to provide a delay drive-hanging device of a paper shredder that, insertion of the paper into the paper entrance activates the micro-switch to allow the blade to shred the paper, and that maintains the driving force for an appropriate period of time even when the micro-switch is no longer stroked by the paper such that the paper can be fully gripped and shredded and such that the paper fragments can be discharged from the blade wheel.

In order to clearly delineate the objects, characteristics and advantages of the present invention, a few preferred embodiments are specifically explained in detail in accompany with the drawings as follows.

DETAILED DESCRIPTIONS OF EMBODIMENTS

This invention is related to a delay drive-hanging device of a paper shredder that is provided with a delay hanging device at a paper entrance of the paper shredder, which device maintains the driving force for an appropriate period of time even after an end edge of the paper has been gripped and when the micro-switch is no longer stroked by the paper such that the paper can be fully gripped and shredded and such that the paper fragments can be discharged from the blade wheel.

Figure 1:
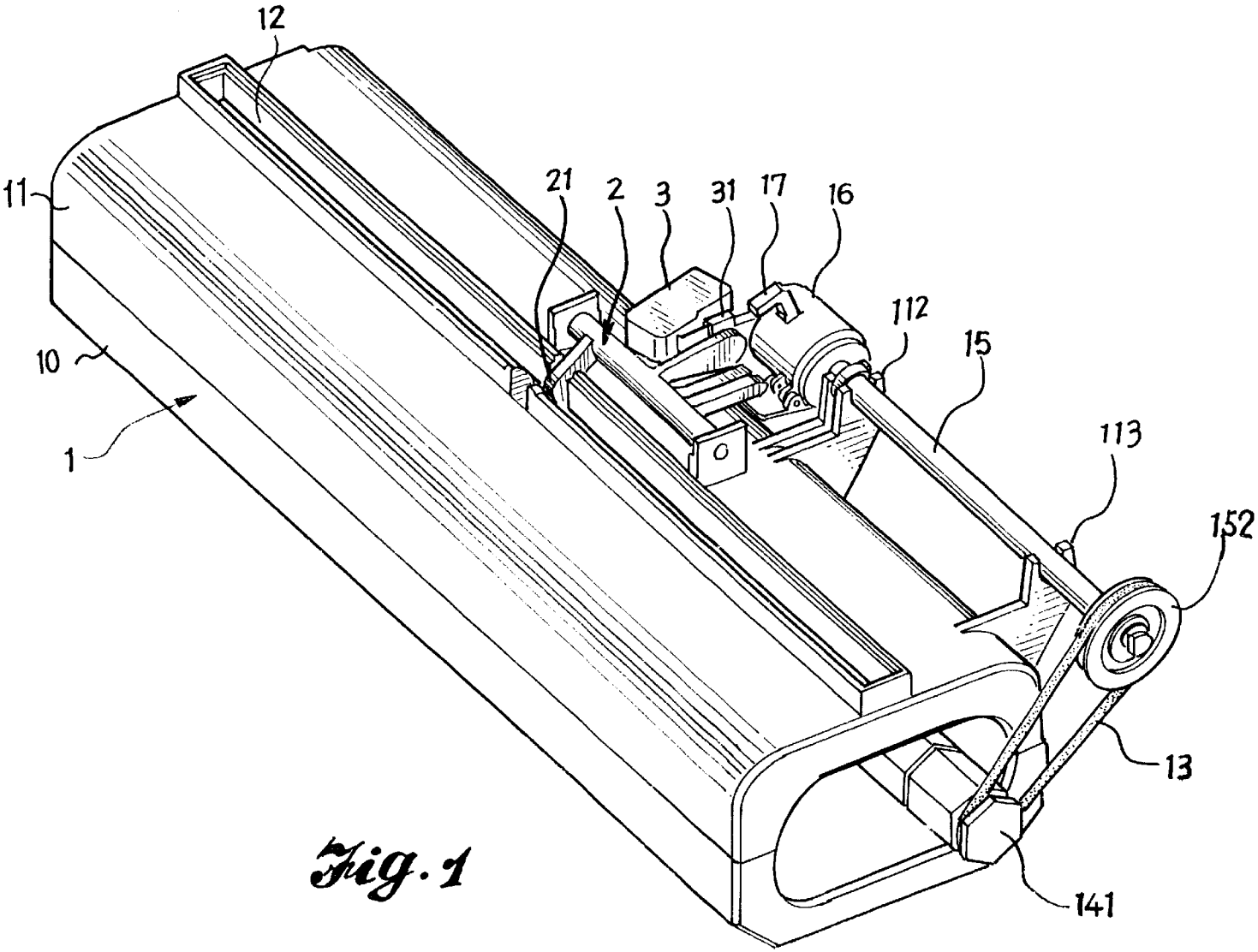
FIG. 1 is a perspective view of this invention.
Figure 2:
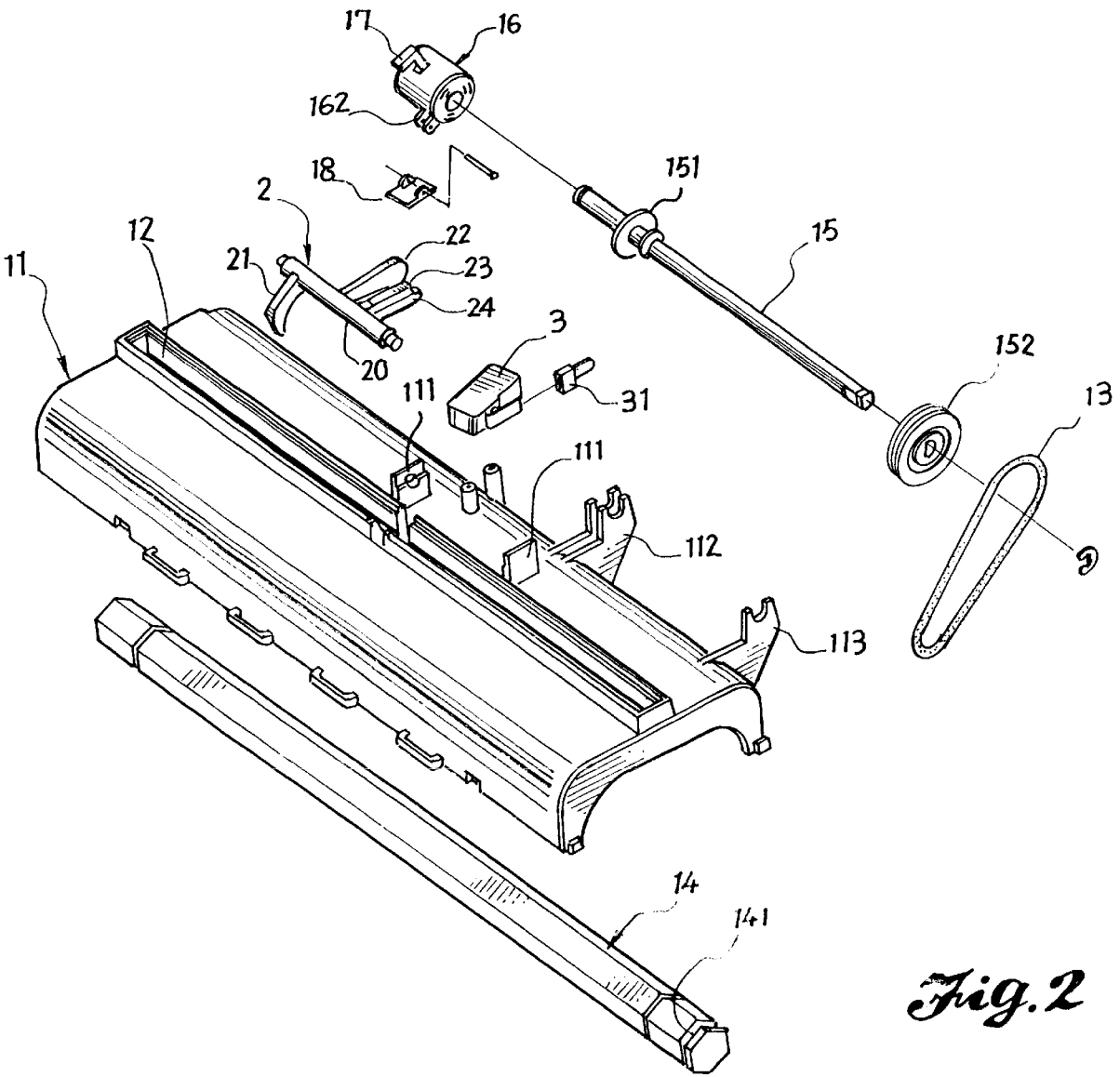
FIG. 2 is an exploded, perspective view of this invention.

FIGS. 1 and 2 illustrate the delay drive-hanging device of a paper shredder according to this invention, wherein a blade wheel shaft 14 of a shredding blade wheel extends out of the machine base 1. The shaft is provided on an end thereof with a belt channel 141 and links to a belt wheel 152 of a driving shaft 15 by means of a belt 13. The driving shaft 15 is supported by shaft supports 112, 113 extending from an upper base the machine base 1 and the driving shaft 15 is integrally formed with a retaining wheel 151 so as to be retained on the shaft supports 112, 113 and driven to rotate by the belt 13. The driving shaft 15 has an end that couples to a control cylinder 16 by means of minute friction. Rotation and halt of the control cylinder 16 controls a delay trigger 2 and a micro-switch 3. The delay trigger 2 and the micro-switch 3 that is connected to a primary circuit are provided between a side of a paper entrance 12 of the upper base and the control cylinder 16. Basically, once the paper is inserted into the paper entrance 12, a paper entry dial 21 of the delay tripper 2 is pressed downwards subjecting a switch dial 22 on another side of the delay trigger 2 to elevate so as to press against a cantilever beam 31 of the micro-switch 3 thereby activating the motor to drive the blade wheel shaft 14 to perform the shredding operation.

Figure 3:
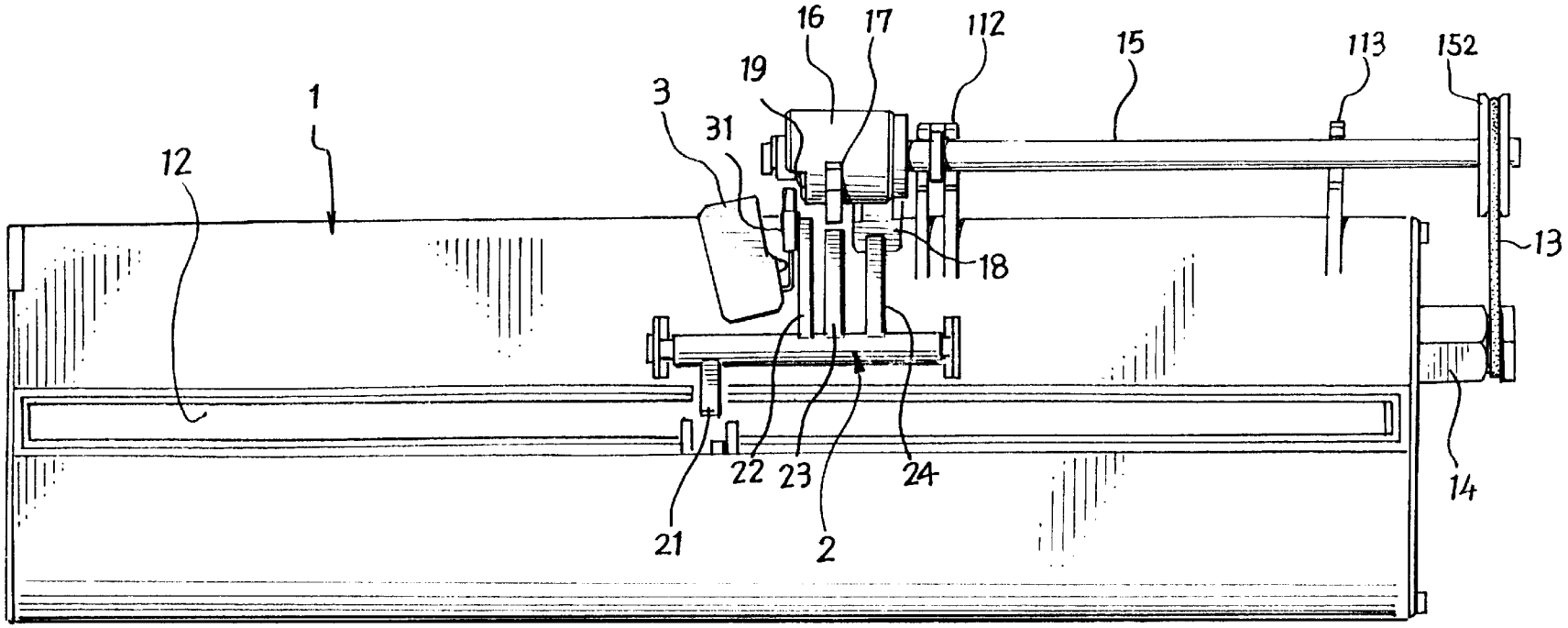
FIG. 3 is a top plan view of this invention.
Figure 4:
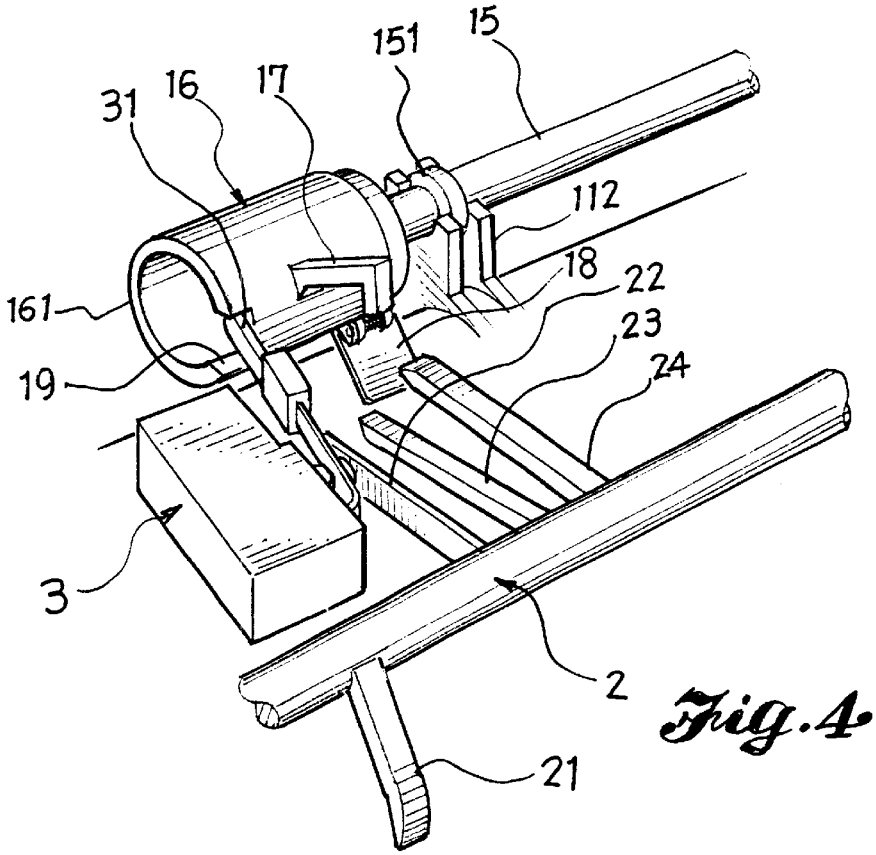
FIG. 4 is a first perspective view showing the characterized portion of this invention.

With reference to FIGS. 3 and 4, the delay trigger 2 is pivotally connected to a shaft support base 111 of the upper base 11. The delay trigger 2 includes a lateral bar 20 that is provided thereon with plural projecting dials, including the paper entry dial 21 provided on a side next to the paper entrance 12, a switch dial 22 provided on another side, and a retaining dial 23 and a recovering dial 24 that, respectively, interact with the micro-switch 3 and the control cylinder 16. The control cylinder 16 is provided on an end thereof with a sliding end face 161. The sliding end face 161 is formed thereon with a notch 19 that corresponds to and controls the cantilever beam 31 of the micro-switch 3. The control cylinder 16 is provided on a medial portion thereof with a projecting, clipping dial 17 that corresponds to and controls the retaining dial 23 of the delay trigger 2. The control cylinder 16 further incorporates a piece of resilient press plate 18 that allows unidirectional movement, and corresponds to and controls the recovering dial 24 of the delay trigger 2.

Figure 5:
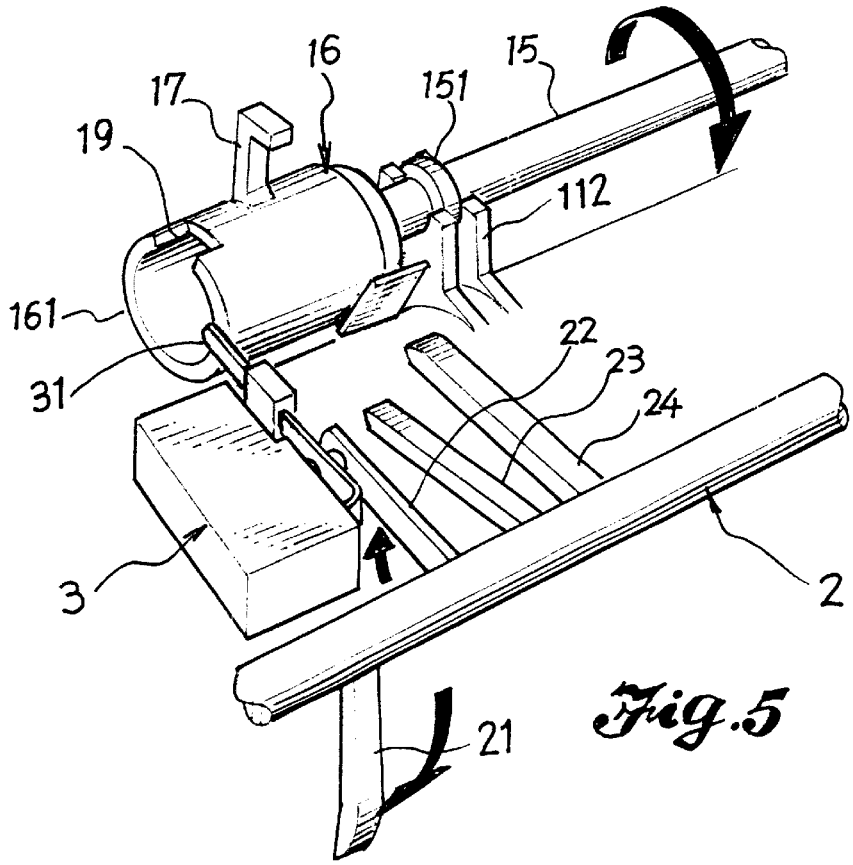
FIG. 5 is a second perspective view showing the characterized portion of this invention.
Figure 6:
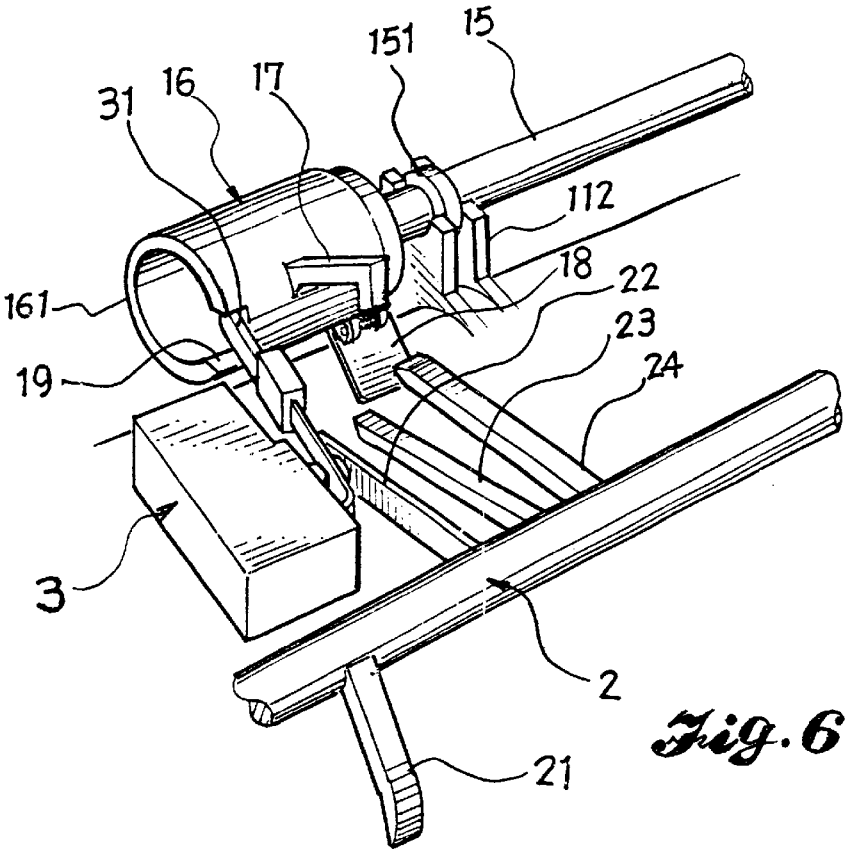
FIG. 6 is a third perspective view showing the characterized portion of this invention.

As a result of the above components and constructions, as shown in FIG. 5, after the paper is inserted into the paper entrance 12, the paper entry dial 21 is pressed downwards subjecting the switch dial 22 on another side of the delay trigger 2 to elevate so as to press against the cantilever beam 31 of the micro-switch 3 and to elevate the cantilever beam 31 from the notch 19 (where the micro-switch 3 is in its deactivated state when its cantilever beam 31 sinks in the notch 19 of the control cylinder 16, and in its activated state while remaining contact with the sliding end face 161) thereby activating the motor to drive the blade wheel shaft 14 to perform the shredding operation. At this moment, the belt 13 drives the driving shaft 15 and the control cylinder 16 to drive rotation of the control cylinder 16 such that the clipping dial 17 contacts with the retaining dial 23 due to the rotation. However, during the entire shredding operation, because the paper continues to press against the paper entry dial 21, the retaining dial 23 is in its elevated state. The control cylinder 16 that is in frictional contact with the driving shaft 15 is halted by resistance (because the pressure exerted by the entering paper is greater than the minute friction of the control cylinder 16). Once the paper has been fully gripped and passed the paper entrance 12, the pressure exerted on the paper entry dial 21 diminishes allowing the retaining dial 23 to press the clipping dial 17 downwards. At this moment, the cantilever beam 31 of the micro-switch 3 should have recovered to its deactivated state because of the downward movement of the switch dial 22; however, because the cantilever beam 31 is now moved to the sliding end face 161 from the notch 19 of the control cylinder 16, the micro-switch 3 is still under pressure and in its activated state. Therefore, the driving dial 15 again drives the control cylinder 16 to continue rotating from a halting state and the cantilever beam 31 urges against the sliding end face 161. The micro-switch 3 does not deactivate the motor until the rotation of the cylinder 16 causes the cantilever beam 31 to sink into the notch 19 (that is, from the state of FIG. 4 to the state of FIG. 5). During such a period of time, the shredding blade wheel can fully grip and shred the paper.

Figure 7:
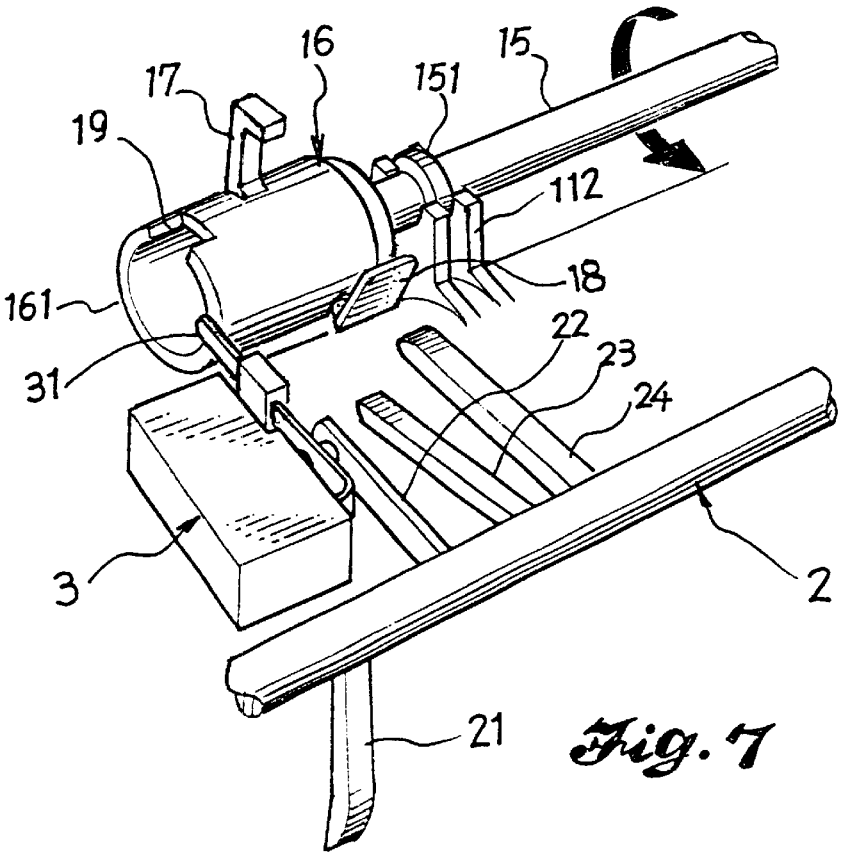
FIG. 7 is a fourth perspective view showing the characterized portion of this invention.

In case of paper jamming that requires one to discharge the paper, reverse rotation can be activated from a switch provided on the paper shredder. As shown in FIG. 7, the driving shaft 15 drives the control cylinder 16 to reverse due to the reverse rotation so as to cause the resilient press plate 18 to be retained at an end of the recovering dial 24, subjecting the switch dial 22 to press against the cantilever beam 31 of the micro-switch 3 and to cause the control cylinder 16 to be free from the driving shaft 15 so as to cease rotation, such that the paper can be discharged because the micro-switch 3 continues to activate the motor to drive the blade wheel shaft 14. During such a process, because the paper presses against the paper entry dial 21 such that the retaining dial 23 is in its elevated stated, the clipping dial 17 is kept away from the retaining dial 23. After the paper has been discharged from the shredding blade, the pressure exerted on the paper entry dial 21 diminishes allowing the resilient press plate 18 to elevate the recovering dial 24 upwards. At this moment, the cantilever beam 31 of the micro-switch 3 should have recovered to its deactivated state because of the downward movement of the switch dial 22; however, because the cantilever beam 31 is now moved to the sliding end face 161 from the notch 19 of the control cylinder 16, the micro-switch 3 is still under pressure and in its activated state. Therefore, the driving shaft 15 again drives the control cylinder 16 to continue rotating from a halting state and the cantilever beam 31 urges against the sliding end face 161. The micro-switch 3 does not deactivate the motor until the rotation of the cylinder 16 causes the cantilever beam 31 to sink into the notch 19 (that is, from the state of FIG. 5 to the state of FIG. 4). During such a period of time, the jammed paper can be fully discharged.

This invention provides a delay drive-hanging device of a paper shredder that, insertion of the paper into the paper entrance activates the micro-switch to allow the blade to shred the paper, and that maintains the driving force for an appropriate period of time even when the micro-switch is no longer stroked by the paper such that the paper can be fully gripped and shredded and such that the paper fragments can be discharged from the blade wheel. This invention is thus a valuable improvement. A patent is hereby submitted and patent rights are respectfully solicited to be granted thereto.

What is claimed is:

1. A delay drive-hanging device of a paper shredder that is provided with a delay hanging device at a paper entrance of the paper shredder, which device maintains the driving force for an appropriate period of time even after an end edge of the paper has been gripped and when the micro-switch is no longer stroked by the paper such that the paper can be fully gripped and shredded and such that the paper fragments can be discharged from the blade wheel, the device includes a shaft end of a blade wheel shaft extending out of a machine base, the shaft end being linked to a driving shaft by means of a belt, the driving shaft being supported by shaft supports extending from an upper base of the machine base so as to be retained on the shaft supports and driven to rotate by the belt, the driving shaft having an end that couples to a control cylinder by means of minute friction, wherein rotation and halt of the control cylinder controls a delay trigger and a micro-switch, and the delay trigger and the micro-switch that is connected to a primary circuit are provided between a side of the paper entrance of an upper base and the control cylinder, whereby once the paper is inserted into the paper entrance, a paper entry dial of the delay tripper is pressed downwards subjecting a switch dial on another side of the delay trigger to elevate so as to press against a cantilever beam of the micro-switch thereby activating the motor to drive the blade wheel shaft to perform the shredding operation, characterized in that:

the delay trigger is pivotally connected to a shaft support base of the upper base, the delay trigger including a lateral bar that is provided thereon with plural projecting dials, including the paper entry dial provided on a side next to the paper entrance, a switch dial provided on another side, and a retaining dial and a recovering dial that, respectively, interact with the micro-switch and the control cylinder; the control cylinder is provided on an end thereof with a sliding end face, the sliding end face being formed thereon with a notch that corresponds to and controls the cantilever beam of the micro-switch; the control cylinder is provided on a medial portion thereof with a projecting, clipping dial that corresponds to and controls the retaining dial of the delay trigger; the control cylinder incorporates a piece of resilient press plate that allows unidirectional movement, and corresponds to and controls the recovering dial of the delay trigger; whereby after the paper is inserted into the paper entrance, the paper entry dial is pressed downwards subjecting the switch dial on another side of the delay trigger to elevate so as to press against the cantilever beam of the micro-switch and to elevate the cantilever beam from the notch thereby activating the motor to drive the blade wheel shaft to perform the shredding operation, and at this moment, the belt drives the driving shaft and the control cylinder to drive rotation of the control cylinder such that the clipping dial contacts with the retaining dial due to the rotation, wherein during the entire shredding operation, because the paper continues to press against the paper entry dial, the retaining dial is in its elevated state; the control cylinder that is in frictional contact with the driving shaft is halted by resistance; once the paper has been fully gripped and passed the paper entrance, the pressure exerted on the paper entry dial diminishes allowing the retaining dial to press the clipping dial downwards; and at this moment, the cantilever beam of the micro-switch should have recovered to its deactivated state because of the downward movement of the switch dial, however, because the cantilever beam is now moved to the sliding end face from the notch of the control cylinder, the micro-switch is still under pressure and in its activated state; the driving shaft, thus, again drives the control cylinder to continue rotating from a halting state and the cantilever beam urges against the sliding end face; the micro-switch does not deactivate the motor until the rotation of the cylinder causes the cantilever beam to sink into the notch.

* * * * *